US007722203B2

(12) United States Patent
Longo et al.

(10) Patent No.: US 7,722,203 B2
(45) Date of Patent: May 25, 2010

(54) EVACUATION STATION WITH MULTIPLE LIGHTSTICK ACTIVATION

(75) Inventors: Joseph Cosimo Longo, Feeding Hills, MA (US); Eric James Domingos, Holyoke, MA (US)

(73) Assignee: Cyalume Technologies, Inc., West Springfield, MA (US)

( * ) Notice: Subject to any disclaimer, the term of this patent is extended or adjusted under 35 U.S.C. 154(b) by 0 days.

(21) Appl. No.: 11/875,371

(22) Filed: Oct. 19, 2007

(65) Prior Publication Data

US 2009/0103279 A1 Apr. 23, 2009

(51) Int. Cl.
*F21V 21/00* (2006.01)

(52) U.S. Cl. ..... 362/34; 362/374; 362/254

(58) Field of Classification Search ..... 362/34, 362/374, 254

See application file for complete search history.

(56) References Cited

U.S. PATENT DOCUMENTS 4,186,426 A 1/1980 Gingras
4,626,383 A 12/1986 Richter
5,043,851 A 8/1991 Kaplan
5,446,629 A * 8/1995 Steiger et al. ..... 362/34
5,557,869 A * 9/1996 Douglas ..... 40/542
5,980,055 A 11/1999 Palmer
6,033,080 A 3/2000 Hasegawa
6,065,847 A 5/2000 Palmer
6,079,842 A * 6/2000 Cheng ..... 362/34
6,336,729 B1 * 1/2002 Pavelle et al. ..... 362/34
6,409,237 B1 6/2002 Olshausen
7,033,055 B1 * 4/2006 Rutter, Sr. ..... 362/540

* cited by examiner

*Primary Examiner*—Anabel M Ton
(74) *Attorney, Agent, or Firm*—McHale & Slavin, P.A.

(57) ABSTRACT

A chemiluminescent lightstick evacuation station consisting of a wall mountable fixture that stores a plurality of lightsticks that are accessed by opening the fixture cover. The fixture cover is opened by pivoting from a closed position to an open position wherein a lightstick restraint causes the activation of all stored lightsticks so as to facilitate their removal and use during an emergency. One lightstick may be retained in the device by use of restricted movement housing, and all lightsticks may be made to rotate outwardly for ease of access.

20 Claims, 6 Drawing Sheets

EVACUATION STATION WITH MULTIPLE LIGHTSTICK ACTIVATION

FIELD OF THE INVENTION

This invention is directed toward the field of devices for emergency assistance and more particularly, to a housing of chemiluminescent lightsticks for use in emergency situations.

BACKGROUND OF THE INVENTION

The ability to evacuate an area during an emergency is typically hampered by the loss of ambient lighting. For instance, evacuation from a train or airplane wreck will undoubtedly be made more difficult if no light is available. In fact, the loss of lighting will typically cause a panic situation whether the emergency is a wreck, weather related, an earthquake, or simply a power grid failure. When the evacuation includes numerous people, it is a necessity to stop panic and evacuate in an orderly manner for the safety of all involved. For these reasons, the need for emergency lighting is mandatory under most building codes.

Emergency lighting typically takes the form of fixed lighting powered by an AC source with a DC back-up battery. The reliability of a fixed system is dependant upon the maintenance of the back-up battery but in any event remains a fixed system. Evacuation procedures require the individuals to leave an area, thus the effectiveness of a fixed lighting system becomes problematic. Panic stricken individuals may refuse to leave a lighted area. For instance, the evacuation during an earthquake may require individuals to leave a lighted area, the lack of lighting in the exit way may prevent an orderly and safe evacuation. The survivors of a train or plane crash require the individuals to leave the area wherein a fixed light does not provide any coverage. Public transportation vehicles are especially at risk for inadequate lighting for power is typically provided by direct current, namely a battery source. Battery powered lights are only as good as the battery. If the battery has not been properly maintained or replaced, or becomes damaged during an accident, the battery powered light will fail.

Due to the limitations of fixed lighting and battery powered systems, a well accepted alternative lighting system is the use of chemiluminescent lightsticks. Chemiluminescent lightsticks provide portable light by the use of a chemical reaction not dependent upon any electrical power or batteries.

The long storage life and the excellent quality of light produced from current chemiluminescent lightsticks have made the product a mainstay in the industry for emergencies. A "chemiluminescent composition" is interpreted to mean a mixture or component thereof which will result in chemiluminescent light production when reacted with other necessary reactants in the processes as disclosed herein.

Chemiluminescent lighting devices are commonly used as a supplement and/or replacement for conventional illumination devices such as flashlights and flares. Chemiluminescent devices are non-incandescent products and are most valuable for emergency lighting applications such as when normal electrical power service is interrupted. Additionally, because chemiluminescent devices do not rely on electricity for operation, they are readily and reliably used in wet environments, even under water, where other powered devices could short out and fail.

Chemiluminescent light production generally utilizes a two-component system to chemically generate light. Chemiluminescent light is produced by combining the two components, which are usually in the form of chemical solutions referred to as the "oxalate" component and the "activator" component. The two components are kept physically separate by a sealed, frangible, glass vial containing one component which is housed within an outer flexible container containing the other component. Typically, this outer container is sealed to contain both the second component and the filled, frangible vial. Forces created by intimate contact with the internal vial, e.g. by flexing, cause the vial to rupture, thereby releasing the first component, allowing the first and second components to mix and produce light. Since the objective of this type of device is to produce usable light output, the outer vessel is usually composed of a clear or translucent material, such as polyethylene or polypropylene, which permits the light produced by the chemiluminescent system to be transmitted through the vessel walls.

These devices may be designed so as to transmit a variety of colors by either the addition of a dye or fluorescent compound to one or both of the chemiluminescent reactant compositions or to the vessel. Furthermore, the device may be modified so as to only transmit light from particularly chosen portions thereof.

Examples of such a chemiluminescent system include: U.S. Pat. No. 5,043,851 issued to Kaplan. Kaplan discloses a polygonal, chemiluminescent lighting device which concentrates light in the corners of the device, thus enhancing visibility of light emanating from the light stick portion of the device and optimizing the amount and distribution of light radiated.

U.S. Pat. No. 4,626,383 to Richter et al. discloses chemiluminescent catalysts in a method for producing light in short duration, high intensity systems, and low temperature systems. This invention relates to catalysts for two component chemiluminescent systems wherein one component is a hydrogen peroxide component and the other component is an oxalate ester-fluorescer component.

U.S. Pat. No. 4,186,426 discloses a chemiluminescent lightstick with an attached actuating device stored inside a container having a hinged lid which opens for access to and for display of the lightstick. The container includes a clamping means by which the lightstick is held at a display position holding the lid of the container open. In this mode, the lightstick and container make a convenient lantern.

U.S. Pat. No. 6,336,729 discloses a lighting system including a chemiluminescent stick supported within a holder. A break bar pivotally connected to the cover is initially in a vertical orientation, and temporarily retained by a latch to allow insertion of the lightstick in the holder and closure of the cover. When the cover is closed, the latch is released, which allows the break bar to move behind the lightstick, in a horizontal orientation. When the cover is then opened, the break bar engages the lightstick, and bends the lightstick forward around an edge to illuminate the lightstick.

U.S. Pat. No. 6,033,080 discloses an emergency light device including a chemiluminescent lightstick which can be easily removed. When an operating lever is pushed, an engaging portion of a pivoting member pushes the bottom portion of the chemiluminescent lightstick toward a wall surface. The chemiluminescent lightstick has on the top end thereof a head secured to a hook of a holding member. The chemiluminescent light stick can be easily bent to illuminate by the lever principle with the protuberance of a case body serving as a fulcrum and the engaging portion serving as the point of action. When the operating lever is further pushed, the top end of the pivoting member protrudes frontward to open a top cover and the holding member which has been restricted by the pivoting member is released and it moves upward by the urging force of a flat spring and the pressing force applied by the head of the chemiluminescent lightstick, thus enabling the chemiluminescent lightstick to be removed.

U.S. Pat. No. 5,446,629 discloses a mounted emergency light fixture. The light fixture has a mount assembly and a front cover with a break plate which bends a lightstick inserted into the fixture when the cover is pivoted from a closed to an open position. The mount assembly has a restraining plate and a back side which maintain the Nightstick within the mount when the cover is pivoted to the open position. Hence, after the cover is opened the lightsticks are illuminated and are held in the mount or may be removed to provide emergency lighting.

U.S. Pat. No. 6,065,847 discloses a chemiluminescent lighting device that may include a holder. The holder permits the user to activate the lightstick upon removal from the holder.

The above mentioned prior art all recognize the need for quick access to a lightstick to address emergency situations and the need to have the lightstick readily available. Additionally, in emergency situations, a person attempting to activate the light stick may not have full manual capacity or mental capacity for reasons attributed to the cause of the emergency. The present invention mitigates these problems. What is lacking in the art is a storage container for chemiluminescent lightsticks, the storage container including a means for automatically latching the storage device and activating the lightsticks producing light for illumination of the container and remaining lightsticks.

SUMMARY OF THE INVENTION

The emergency light fixture of the present invention consists of a mounting plate having a lightstick receptacle secured thereto. The receptacle includes a plurality of sockets available for receipt of the lightsticks which are accessed by opening a front cover. The cover is opened by pivoting from a closed position to an open position wherein a lightstick restraint causes the activation of all stored lightsticks so as to facilitate their removal and use during an emergency. One lightstick may be retained in the device by use of restricted movement housing, and all lightsticks may be made to rotate outwardly for ease of access.

The device may be mounted on any convenient, substantially planar surface such as a wall, preferably at a previously selected, accessible location. For instance, the mounting plate may be placed near the exit door on a train, plane, boat or cruise ship, motel, apartment hallway, school hallway, locker room, factory exit lane, stair wells and so forth. The proper placement is where a potential user of the device will be able to find the light source in an emergency because the fixture is easily accessible and because the light is permanently mounted at a predetermined, consistent location. Also unique to chemiluminescent devices are their ability to produce light without generating heat. Since chemiluminescent devices are not electrically operated or sources of ignition, they are ideally suited to emergency situations such as the aforementioned disasters. For instance, in situations where flammable vapors such as gasoline or natural gas may be present, conventional illumination such as candles, lanterns or even flashlights pose extreme danger as potential sources of ignition.

In operation, the lightsticks are positioned in the fixture and retained in position while the device is in a closed position. Then, when the cover of the fixture is pivoted to the open position, the unshaped channel holds an end of each lightstick resulting in the bending and activation of the lightsticks.

When the cover is pivoted to a sufficient angular extent with respect to the plane of the back side of the mount assembly, the light stick will bend sufficiently to break the ampoules within the Nightstick and then, as the cover is further pivoted, the remaining lightsticks are made available for ease of removal from the mounting plate.

Accordingly, moving of the cover to a fully opened position allows ease of lightstick access. The activation procedure is performed by simply pulling down the cover.

An objective of the instant invention is to provide an evacuation station capable of being mounted on any surface and providing activation of multiple chemiluminescent lightsticks.

Another objective of the instant invention is to provide an evacuation station having a plurality of lightsticks that operate as the latching mechanism so as to provide automatic arming by placement of a lightstick into a latching bracket.

Still another objective of the instant invention is to provide an evacuation station having an enclosure so as to prevent ambient light during storage to prolong the useful life of the chemiluminescent chemicals.

Still another objective of the instant invention is to provide evacuation station for use with chemiluminescent lights that include security tags to indicate that the contents have not been disturbed by vandals.

Yet another objective of the instant invention is to provide an evacuation station having a front panel with an integrated handle for ease of opening by use of leverage allowing ease of activating the lightstick held in the latching bracket.

Yet still another objective of the instant invention is to provide an evacuation station having a front cover of substantial height and width that allows for placement of indicating indicia providing evacuees with instructions in operation and usage.

Yet still another objective of the instant invention is to provide a tilt out socket holder that allows ease of access of the stored lightsticks when the front cover is placed in an open position.

Still another objective of the instant invention is to provide a holder for activating a plurality of lightsticks and, upon activation, capture of the lightsticks to maintain illumination of the exit way.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE INVENTION

Figure 3:
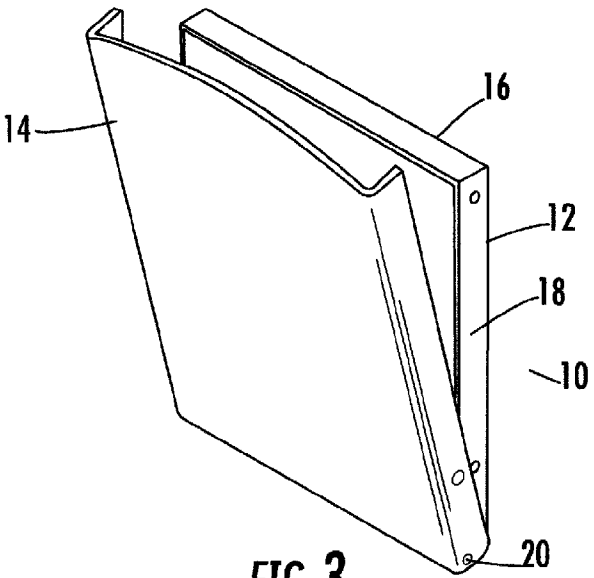
FIG. 3 is a perspective view of the storage container illustrated in FIG. 1 in a partially opened position.

Referring now in general to FIGS. 1-6, set forth is an emergency light fixture (10) consisting of a mounting plate (12) available for securement to a mounting surface such as a wall, vertical support beam, door or the like upright surface. Attachment of the mounting plate to a vertical surface is by adhesive, double-sided tape, glue, screws, nails or the like fasteners. The front surface (19) of the mounting plate is exposed when the front cover (14) is placed in an open position allowing concealment of the more permanent mounting fasteners such as nails or screws. The mounting plate has a peripheral edge (16) extending around the outer edge formed by the mounting plate with an outward extending wall (18). The front cover (14) is attached by a hinge (20) located along the bottom of the sidewall and is operatively associated with the mounting plate sidewall. The front cover (14) includes a hand hold (24) that allows for placement of an individuals fingers for ease of pulling the cover from a closed position (FIG. 1), to an open position (FIG. 6) with the hand hold (24) placed along an upper edge (26) of the front cover providing optimal leverage when used in conjunction with the lower mounted pivot hinge (20). The walls of the mounting plate and front cover operate to block light from entering the device while in a closed position.

Figure 10:
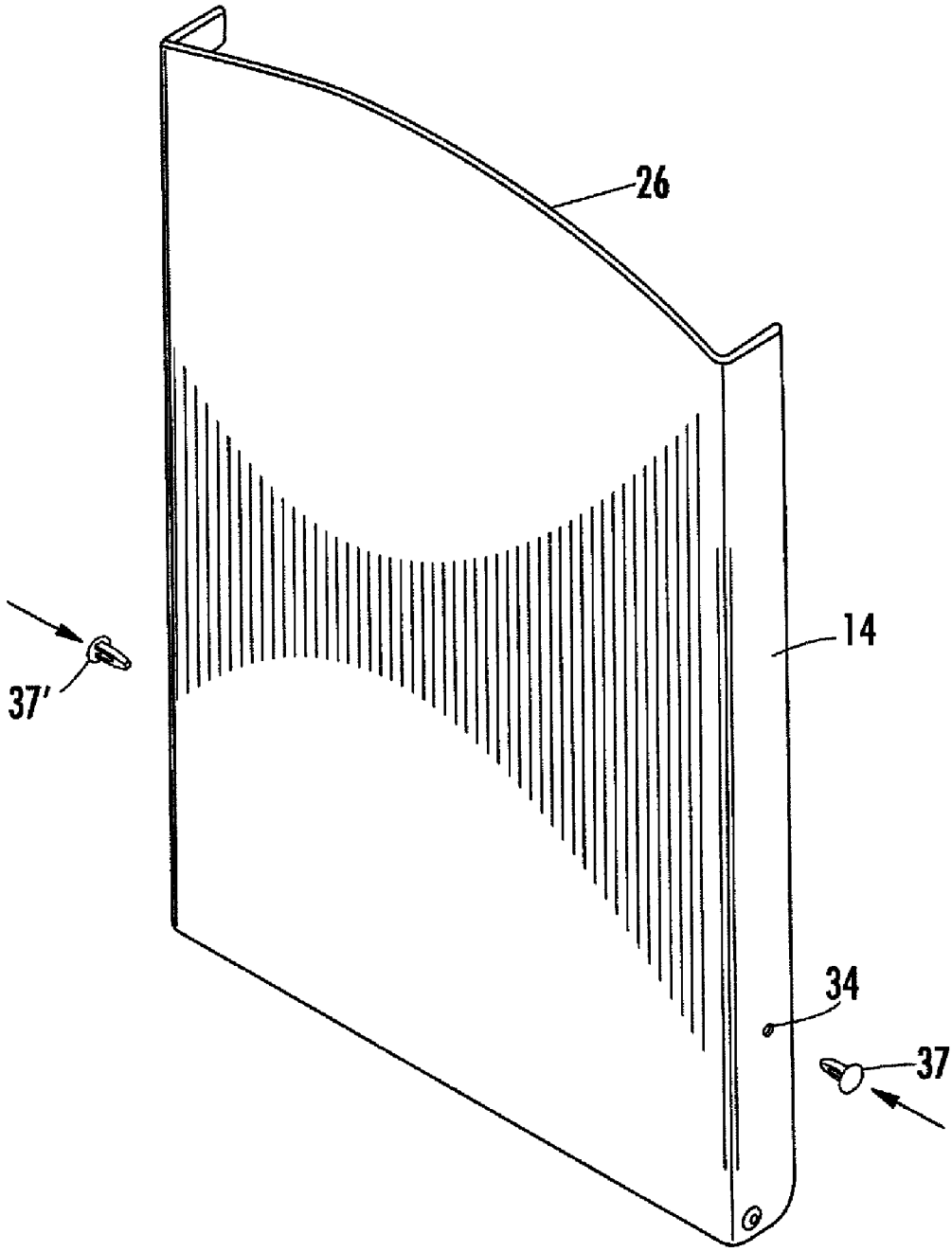
FIG. 10 is a perspective view illustrating insertion of the tamper tags.

The front cover (14) has an outer surface having a width and height for placement of indicia either molded in, or by use of a fluorescent or photoluminescent decal which would allow the evacuation station to glow when there is a lack of natural light. The decal may exhibit instructions such, as an arrow indicating the user to pull down on the cover so as to activate the emergency light fixture, or the like instruction for operation and exit. The front cover (14) further includes partitions (80) that are formed by socket separators (81) and held in position by a support rod (82). The support rod (81) positions a plurality of lightsticks (50) in position along the inner surface of the cover. The cover (14) and mounting plate having apertures (34) & (36) allowing placement of tamper indicator tags (37 & 37) as shown in FIG. 10, which provides evidence that the evacuation station has not been tampered with since the loading of the lightsticks, the tamper tags are severed upon the opening of the cover. The tamper tags assure that the chemicals have not been exposed to light thereby providing extended life with the knowledge that all lightsticks placed within the evacuation station are ready should there be an evacuation procedure.

Within the mounting plate (12) is located an activation flange (90) consisting of an upright panel that captures an edge of each lightstick upon the installation wherein each lightstick falls into a holding area (91) formed by the activation flange (90). The activation flange has the purpose of maintaining the lightsticks (50) in a position substantially parallel to the inner surface of the mounting plate. The activation flange results in the securement of the cover in an upright position parallel to the mounting plate wherein the lightsticks are situated within the activation holding area. The tamper tabs (36) may then be placed into the apertures to indicate an armed and untampered position.

Figure 6:
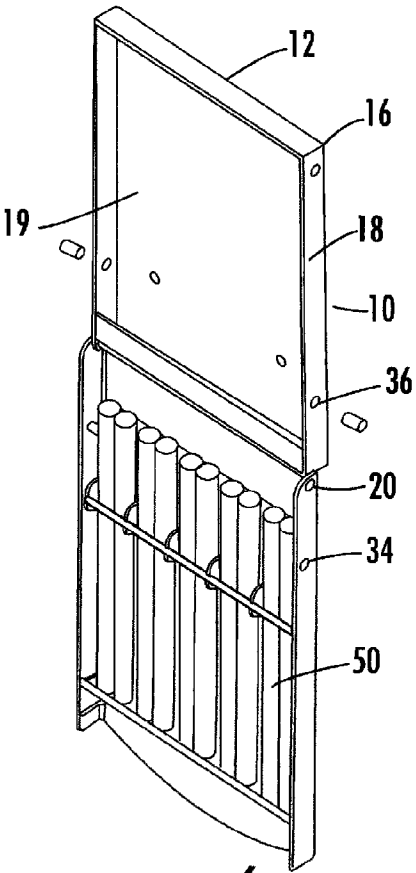
FIG. 6 is a perspective view of the storage container illustrated in FIG. 1 in an opened position.
Figure 5:
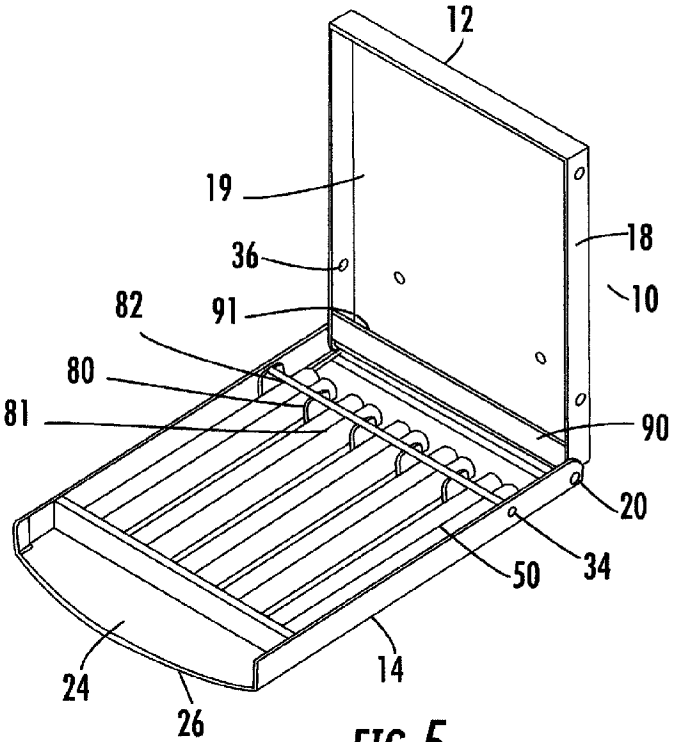
FIG. 5 is a perspective view of the storage container illustrated in FIG. 1 in a rotated position.

Referring now to FIGS. 5 and 6, shown is an open view of the emergency light fixture (10) having a mounting plate (12) with the outwardly extending sidewall (18) extending around the peripheral edge of the mounting plate. The mounting plate is further defined as a front side (19) and a backside (21). The front side allows for concealment of fasteners and further operates as an inner wall so as to inhibit ambient light from reaching the lightsticks during the storage period. The backside (21) is available for securement to the wall again with most any type of fastener depending upon the type of installation warranted. For instance, the use of conventional screw or nail fasteners onto a metal post is impractical wherein adhesive or two way tape is more practical. In addition, placement of fasteners on the skins of vehicles such as airplanes or trains is also impractical wherein a flat backside allows for various types of adhesives for attachment. In instances where the evacuation station is placed against wall paper it would be more feasible to use conventional fasteners such as dry wall fasteners or screws so as to provide securement into otherwise weak surfaces.

The front cover (14) includes a plurality of partitions (80) for storage of the lightsticks (50). Depicted is a holder of ten lightsticks, all of which are activated upon the opening of the cover. The partitions create sockets (81) for positioning of the lightsticks. A support rod (82) maintains the lightsticks in position. A holder may be designed with more or less lightsticks and would be considered within the scope of this invention.

Figure 2:
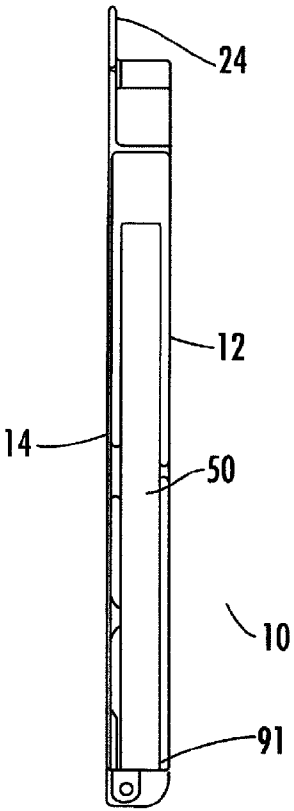
FIG. 2 is a cross-sectional side view of FIG. 1.
Figure 1:
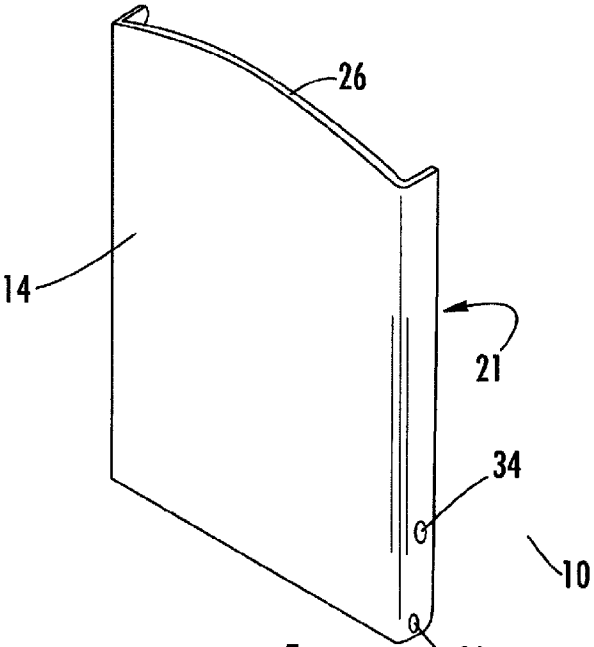
FIG. 1 is a perspective view of the storage container in a closed position.
Figure 4:
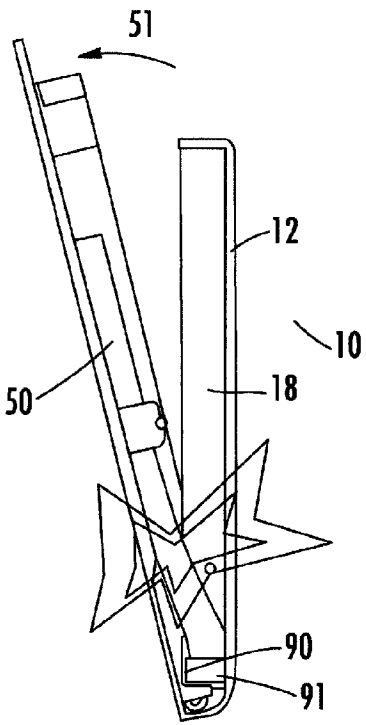
FIG. 4 is a cross-sectional side view of FIG. 1 in a partially opened position with a pictorial of lightstick activation.

In operation, the lightsticks (50) need to be placed within the activation holder (91) so as to maintain the lightsticks in a fixed and parallel position relative to the front cover. When the front cover is being placed into a closed position, the end of the lightsticks fall into the activation holding area. As shown in FIGS. 1 & 2, the distal end of the lightsticks (50) are situated in the activation holding area (91) when the cover is in the closed and armed position. To access the lightsticks the cover (14) must be drawn outwardly from the mounting plate (12), as depicted in FIGS. 3 & 4, the operation of which causes activation of the lightsticks (50). The activation resulting from the placement of the lightsticks within the activation flange (90) wherein the outward movement of the cover, as depicted by arrow (51), results in the bending of the lightsticks. The effect is the rupturing of the frangible ampoule within the lightstick resulting in the mixture of the chemiluminescent chemicals for purposes of illumination.

The cover is hingedly attached along the lower end (22) so as to allow the tilting of the lightsticks away from the front side (19) of the mounting plate when the front cover is placed in an open position. FIGS. 5 and 6 illustrate the cover tilted forward which allows access of the lightsticks. The support rod (82) is strategically position for holding of the lightsticks (50) in an upright position. One of the benefits of chemiluminescent lighting devices is the ability to provide light upon demand. However, the chemicals that cause the chemiluminescent reaction must be properly protected to prevent premature chemical degradation. Chemiluminescent chemicals are subject to degradation but, if shielded from light, optimum illumination can be expected if properly stored. For this reason, conventional lightstick storage includes an aluminum foil package. To activate a conventional chemiluminescent lightstick, an individual must tear open the foil package, remove the packaging from the device, and then activate the device to cause the chemical reaction and subsequent illumination. In instances of an evacuation, the time needed to open individual packages may not be available, nor may a person have the dexterity necessary to rip open the package. Thus, the use of the enclosed fixtures with cooperating sidewalls allows the storage of unpackaged lightsticks that have a long life as they remain protected from light while secured in the fixture.

Examples of suitable light stick products for use herein are the light sticks sold by Cyalume Technologies LLC under the trademarks "Cyalume" and "Snaplight". Further details concerning the construction and operation of chemiluminescent lighting devices may be found in U.S. Pat. Nos. 3,539,794; 3,576,987; 4,508,642; 4,193,109; 4,814,949 and 5,043,851; the subject matter of which patents are incorporated herein by reference.

Figure 7:
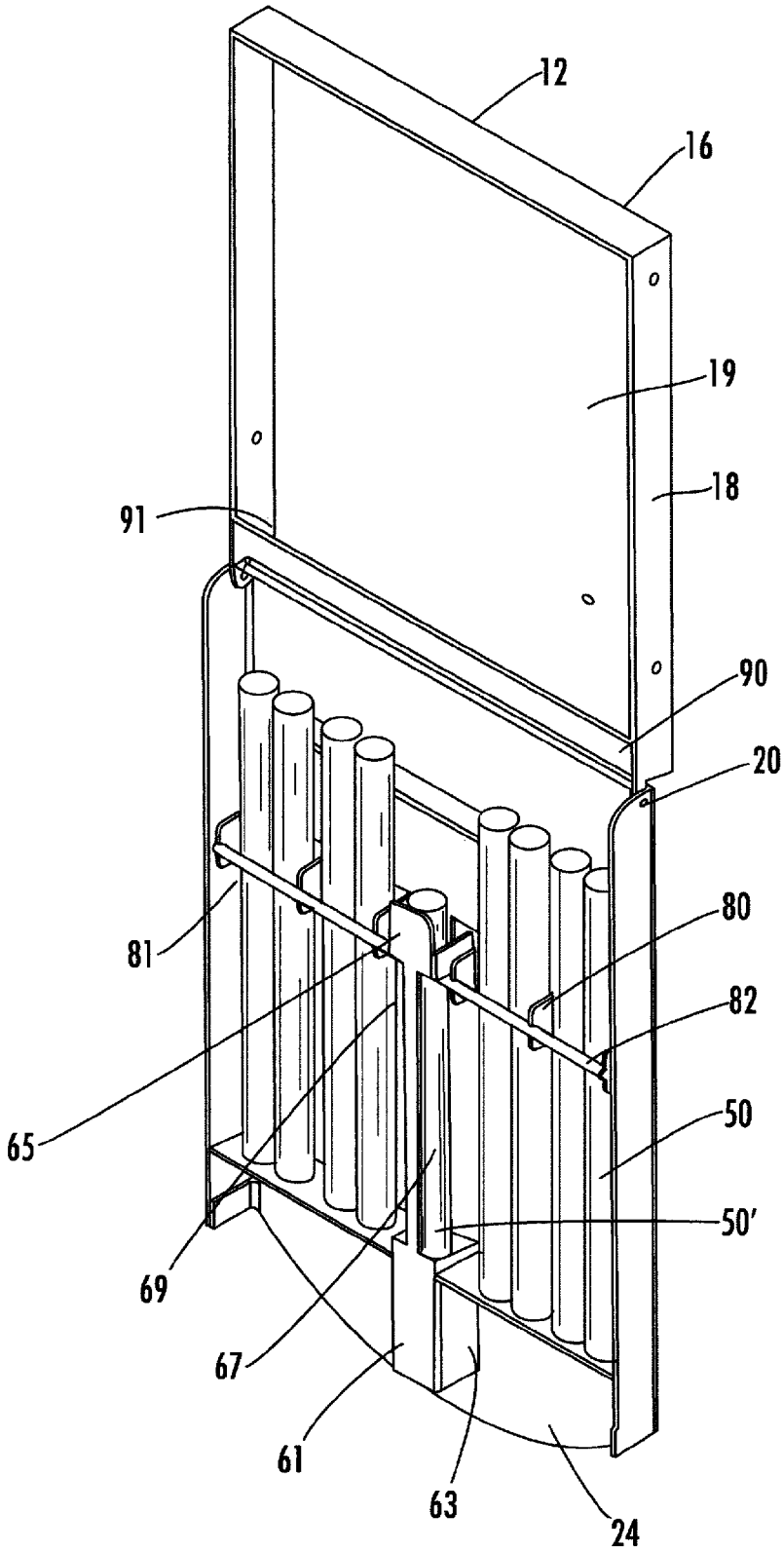
FIG. 7 is a perspective view of a second embodiment of the invention securing a lightstick, illustrated in an opened position.
Figure 8A:
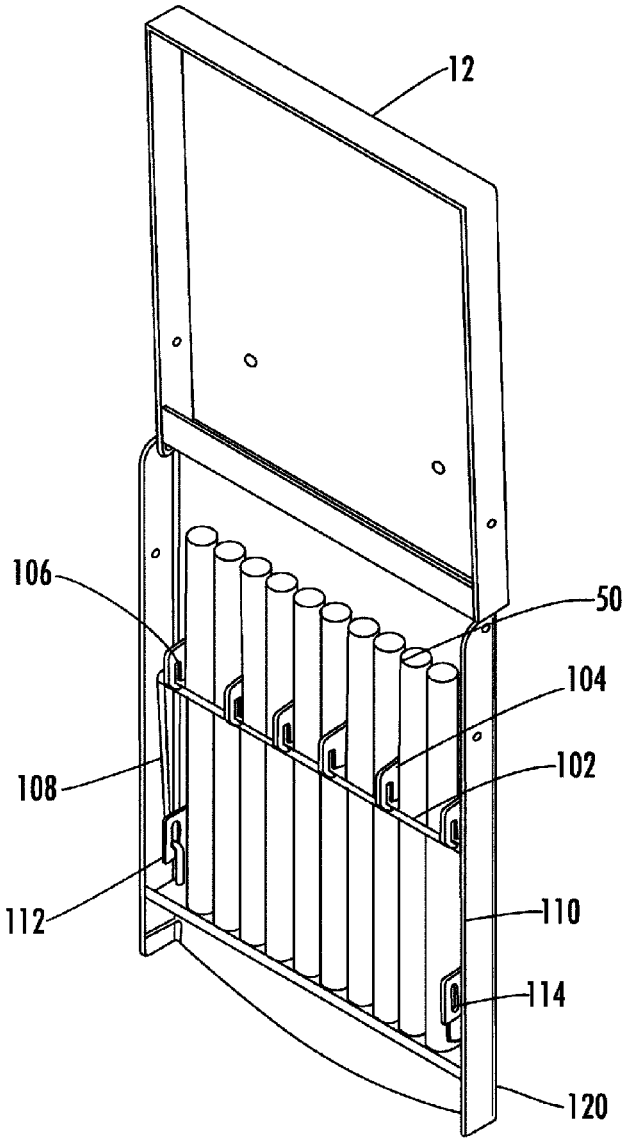
FIG. 8A is a perspective view of a storage container including a tilt bracket for ease of access.
Figure 8B:
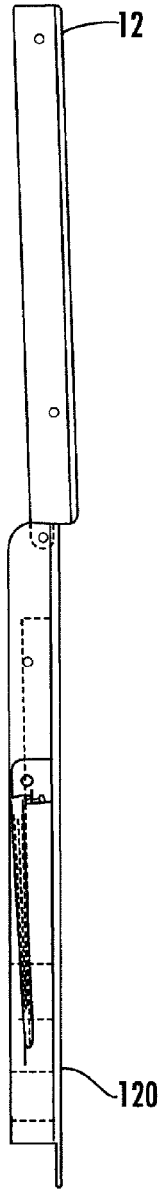
FIG. 8B is a cross-sectional side view of FIG. 8A.
Figure 9A:
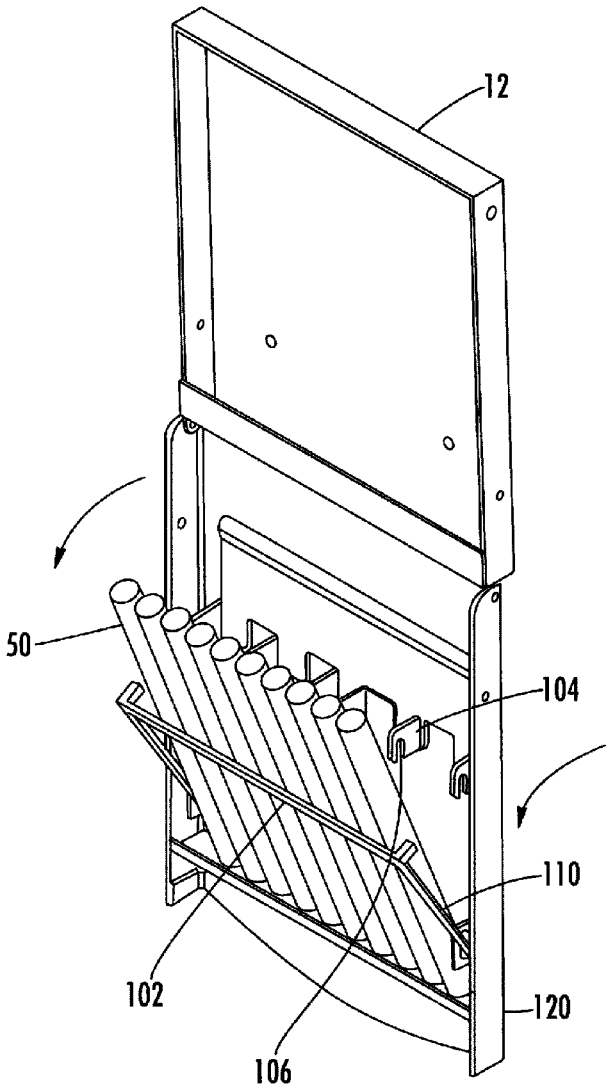
FIG. 9A is a perspective view of a the storage container illustrated in FIG. 8A with the tilt bracket activated.
Figure 9B:
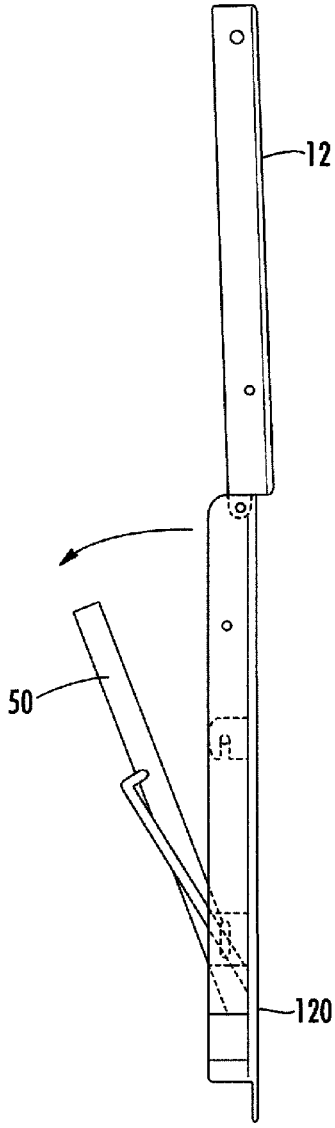
FIG. 9B is a cross-sectional side view of FIG. 9A.

Referring now to FIG. 7, set forth is an alternative embodiment wherein one lightstick (50') is retained. In this embodiment, the retainment of a single lightstick allows the evacuation station to operate as an exit illumination light, even when all the stored lights have been removed. This is helpful in a situation where the number of evacuees may vary, such as in building stairwells. The device consists of a mounting plate (12) having a front surface (19) that is exposed when the front cover (14) is placed in an open position allowing concealment of mounting fasteners. The mounting plate has a peripheral edge (16) extending around the outer edge formed by the mounting plate with an outward extending wall (18) allowing long life storage by concealment of the lightsticks from ambient light. The front cover (14) is attached by a hinge (20) located along the bottom of the sidewall an operatively associated with the mounting plate sidewall. The front cover (14) includes a hand hold (24) that allows for ease of pulling the cover from a closed position to an open position. The front cover (14) further includes partitions (80) that are formed by socket separators (81) and held in position by a support rod (82). The support rod (82) positions a plurality of lightsticks (50) in position along the inner surface of the cover. Within the front cover (14) is located an activation flange (90) consisting of an upright panel that captures an edge of each lightstick upon the installation wherein the each lightstick falls into a holding area (91) formed by the activation flange (90). The lightsticks (50) are all automatically activated and upon opening of the front cover, one lightstick (50') falls into a housing (61) having a covered base that prevents access to the lower end of the lightstick (50') and raised tab (65) that prevents access to the upper end of the lightstick. Light from the lightstick passes through apertures (67) & (69) as well as from the uncovered top. The inner surface of the cover may include reflective material that enhances the light generated from the remaining lightstick (50'), or may include indicia in the form of an exit sign or instructions, all of which would assist the remaining evacuees as they leave the area.

Now referring to FIGS. 8A-9B, illustrated is an embodiment which includes a movable support rod (102) and partitions (104) each include rod slots (106). The support rod (102) includes a downward extending leg (108) and (110) each having a distal end engaging alignment brackets (112) and (114). When the cover is in a closed upright position, the support rod engages the slots of the partitions to maintain the lightsticks (50) in a position parallel to the front cover (120). Once the front cover (120) has been opened and the lightsticks inverted, the support rod (102) slides down the slots (106) wherein the support rod (102) may now pivot outward together with the lightsticks (50). The distal end of the support rod (108) and (110) are of a length sufficient to allow pivoting of the support rod (102) to a position where the lightsticks are angled at about 45 degrees. The actual degree of angle can be set by adjusting the length of the distal end (108 & 110) of the support rod (108). It should be noted that the securement of a single lightstick, as shown in FIG. 7, may be used in this embodiment.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is show n and described in the specification and drawings/figures.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An emergency light fixture consisting of:

a mounting plate having a front side and a back side with a peripheral edge, and an outwardly extending side wall formed integral with said peripheral edge;

a flange extending perpendicularly to the bottom side wall to form a generally u-shaped channel at the bottom of said mounting plate adapted to receive lightsticks therein;

a front cover hingedly attached to said mounting plate, said front cover having an inwardly extending side wall operatively associated with said outwardly extending side wall and a latching bracket configured for securing said lightsticks in a position generally parallel to said front cover;

wherein opening of said front cover due to an emergency event causes any of said lightsticks having a first end that is received within said generally u-shaped channel to flex resulting in illumination thereof.

2. The light fixture of claim 1 including a fastening means for securing said mount assembly to a fixed surface.

3. The light fixture of claim 1 wherein a hand hold is formed in said cover for ease of pulling the cover from a closed to an open position, said lightsticks held in said cover.

4. The light fixture of claim 1 wherein said outwardly extending side walls and said inwardly extending side walls cooperate to prevent exposure of the light sticks to ambient light when said front cover is in a closed position.

5. The light fixture of claim 1 wherein the front cover has an outer surface and is shaped to receive a decal with instructions indicating how to activate said fixture and an element which glows in dark surroundings to signal the location of the fixture.

6. The light fixture of claim 1 wherein said lightstick is of a distinct wavelength or color.

7. The light fixture of claim 1 including a tamper indicating pin that extends through a first aperture in at least one outwardly extending side wall and a second aperture in one inwardly extending side wall, wherein said first and second apertures are in alignment when the cover is in a closed position.

8. The light fixture of claim 1 wherein the latching bracket includes a rod having a first and second end, the first end of said rod is mounted in a first mounting aperture formed in a vertically oriented inwardly extending wall on said front cover and the second end is mounted in a second mounting aperture that is formed in a second vertically oriented inwardly extending wall on said front cover.

9. The light fixture of claim 8 wherein the latching bracket further includes a retaining member which inhibits the removal of at least one lightstick when the cover is in the open position.

10. The light fixture of claim 1 wherein the latching bracket includes a rod that is pivotally mounted upon the inwardly directed walls of the front cover such that the lightsticks are displayed in an angled fashion when the cover is in the open position to facilitate removal of the lightsticks from the light fixture.

11. An emergency light fixture consisting of:

a mounting plate having a front side and a back side with a peripheral edge, and an outwardly extending side wall formed integral with said peripheral edge;

a flange extending perpendicularly to the bottom side wall to form a generally u-shaped channel at the bottom of said mounting plate adapted to receive lightsticks therein;

a front cover hingedly attached to said mounting plate, said front cover having an inwardly extending side wall operatively associated with said outwardly extending side wall and a latching bracket configured for securing said lightsticks in a position generally parallel to said front cover;

wherein when said front cover is in a closed and armed position each of said lightsticks has one end seated within said generally u-shaped channel and at least another portion of each of said lightsticks maintained in their position by a support rod on the front cover;

wherein when the cover is moved from a closed to open position each light stick is caused to flex resulting in illumination of each of said light sticks.

12. The light fixture of claim 11 including a fastening means for securing said mount assembly to a fixed surface.

13. The light fixture of claim 11 wherein a hand hold is formed in said cover for ease of pulling the cover from a closed to an open position.

14. The light fixture of claim 11 wherein outwardly extending side walls and said inwardly extending side walls cooperate to prevent exposure of the light sticks to ambient light when said front cover is in a closed position.

15. The light fixture of claim 11 wherein the front cover has an outer surface and is shaped to receive a decal with instructions indicating how to activate said fixture and an element which glows in the dark surroundings to signal the location of the fixture.

16. The light fixture of claim 11 wherein said lightstick is of a distinct wavelength or color.

17. The light fixture of claim 11 including a tamper indicating pin that extends through a first aperture in at least one outwardly extending side wall and a second aperture in one inwardly extending side wall, said first and second apertures are in alignment when the cover is in a closed position.

18. The light fixture of claim 11 wherein the latching bracket includes a rod having a first and second end, the first end of said rod is mounted in a first mounting aperture formed in a vertically oriented inwardly extending wall on said front cover and the second end is mounted in a second mounting aperture that is formed in an second vertically oriented inwardly extending wall on said front cover.

19. The light fixture of claim 18 wherein the latching bracket further includes a retaining member which inhibits the removal of at least one lightstick when the cover is in the open position.

20. The light fixture of claim 11 wherein the latching bracket includes a rod that is pivotally mounted upon the inwardly directed walls of the front cover such that the lightsticks are displayed in an angled fashion when the cover is in the open position to facilitate removal of the lightsticks from the light fixture.

* * * * *